United States Patent [19]

Lowry et al.

[11] Patent Number: 5,056,444

[45] Date of Patent: Oct. 15, 1991

[54] METHOD AND APPARATUS FOR AUTOMATICALLY STEERING AND ADJUSTING THE HEIGHT OF A NEEDLE IN A CHENILLE TYPE EMBROIDERY MACHINE

[75] Inventors: Robert G. Lowry, Highlands Ranch; Ronald C. Rockwell, Aurora, both of Colo.

[73] Assignee: Melco Industries, Inc., Denver, Colo.

[21] Appl. No.: 575,435

[22] Filed: Aug. 29, 1990

[51] Int. Cl.[5] ..... D05B 69/00; D05C 3/02

[52] U.S. Cl. ..... 112/221; 112/80.42; 112/98

[58] Field of Search ..... 112/98, 221, 220, 80.4, 112/80.42, 80.44, 235, 237

[56] References Cited

U.S. PATENT DOCUMENTS

| | | | |
|---|---|---|---|
| 1,137,654 | 4/1915 | Myers | 112/98 |
| 2,390,288 | 12/1945 | Ballamy et al. | 112/221 |
| 2,402,251 | 6/1946 | Johnson | 112/221 X |
| 2,407,148 | 9/1946 | Garcia | 112/221 X |
| 2,573,043 | 10/1951 | Montgomery | 112/80.4 |
| 4,325,313 | 4/1982 | Kawai et al. | 112/221 X |
| 4,461,226 | 7/1984 | Tajima | 112/98 |
| 4,569,297 | 2/1986 | Düsch | 112/221 |
| 4,606,285 | 8/1986 | Tajima | 112/98 |
| 4,640,208 | 2/1987 | Glenn et al. | 112/265.1 |
| 4,640,209 | 2/1987 | Glenn et al. | 112/429 |

OTHER PUBLICATIONS

NARA Sewing Machine Industrial Co., Ltd., Tokyo, Japan, Treasure Handle Operating Embroidery Machine, Model ES-1114, Instruction Manual.

Troy Thread & Textile Corp., Chicago, Ill., Instructions for the Use of the Single Needle Chainstitch & Chenile Stitch Embroidery Machine.

The Singer Manufacturing Co., List of Parts, Singer Machines Nos. 114W103 and 114W104.

Tajima Publication, Instructions and Operational Information for a Tajima Chenille Embroidery Machine.

*Primary Examiner*—Werner H. Schroeder
*Assistant Examiner*—Paul C. Lewis
*Attorney, Agent, or Firm*—Sheridan, Ross & McIntosh

[57] ABSTRACT

A chenille type embroidery machine (10) has an apparatus for rotational steering and height adjustment of a needle (22). An actuator (24) locks or unlocks a locking clip (92) to allow the needle (22) to rotate with a needle height adjuster assembly (46) or to be moved vertically up or down. The needle assembly (46) comprises the needle (22), a needle bar 23, a bar clamp (70), a height adjuster locking block (84), an internal needle height adjuster (88), the locking clip (92) and springs (108*a–d*). When the actuator (24) is in its "unactuated" condition, the height adjuster locking block (84) is locked to the internal needle height adjuster (88) by the locking clip (92) for rotation therewith. In the unactuated condition, the needle (22) is rotationally steered with the assembly (46). In the "actuated" condition, the actuator (24) extends a shaft (126) to move the locking clip (92) and disengage the locking block (84) from the internal adjuster (88). In the actuated condition, the internal adjuster (88) is free to turn while the locking block (84) remains stationary and the needle (22) moves vertically up or down.

25 Claims, 4 Drawing Sheets

METHOD AND APPARATUS FOR AUTOMATICALLY STEERING AND ADJUSTING THE HEIGHT OF A NEEDLE IN A CHENILLE TYPE EMBROIDERY MACHINE

TECHNICAL FIELD OF THE INVENTION

This invention relates in general to embroidery machines, and in particular to a method and apparatus for automatically steering and adjusting the height of a needle in a chenille type embroidery machine.

BACKGROUND OF THE INVENTION

Chenille type embroidery machines provide a "fuzzy" appearance of a pattern, for example, such as on an athletic award or "letter". The "fuzzy" appearance is formed by the use of a hooked needle which, in combination with a "looper" (which wraps thread around the needle), pulls a thread through a piece of material. Such a stitch is known as a "moss" stitch and is performed by the looper looping thread over the hook of the needle below the material to be embroidered. The needle then pulls the looped thread through and above the material. Another device known as the X/Y drive then pulls the material away from the raised needle causing the looped thread to slip off the hook. The needle again penetrates the material and the process is repeated, resulting in a "fuzzy" patterned item.

By reversing the hook of the needle so that the looped thread remains on the hook after the X/Y movement of the material, another stitch known as a "chain" stitch can be formed. The X/Y drive pulls the material and the thread as in the "moss" stitch procedure, but now the thread remains on the hook as the needle repenetrates the material and a linked "chain" stitch is formed.

Whichever stitch type is chosen, the X/Y drive of the chenille machine moves in a prescribed sequence of appropriate increments along a horizontal plane to allow the design to be embroidered onto the material. As the material moves in the horizontal plane, it is important to maintain the orientation of the hook of the needle to the X/Y frame movement. Thus, it is necessary to have a steering mechanism which allows the needle to turn to maintain the prescribed relationship to the X/Y frame movement to form a "moss" or a "chain" stitch.

It is also necessary to be able to adjust the needle to a specific height for the looped thread to be pulled through the material. The higher the needle, the higher or "fuzzier" is the appearance of the design or the longer is the link in the "chain" stitch which causes the "chain" to become "fatter" or "thinner" in appearance. It is also necessary to position the needle at a "home" position which is above the embroidered design in order to allow the material containing the design to be removed from the machine. Therefore, a mechanism is required to steer the needle rotationally as well as to position the needle vertically.

There are known chenille machines which perform these functions either automatically or manually. One embroidery machine, the Model ES-1114 TREASURE ®, by Nara Sewing Machine Industrial Co., Ltd., of Tokyo, Japan utilizes a manual operation. To steer the needle, a steering handle is provided which must be controlled by the operator. Additionally, the needle height is set manually by adjusting a needle holder. Thus, to sew a design of a desired height, the operator must manually set the height and manually steer the needle. Obviously, this requires skill and is at best a relatively slow process.

One known arrangement for automatic rotational steering and vertical height adjustment is used in chenille embroidery machines manufactured by Tajima Industries Ltd. of Japan. The Tajima machine comprises a first motor and a first driven shaft with a gearing arrangement for automatically steering the needle in accordance with a prescribed design. There is a second motor and a second driven shaft and gearing arrangement for positioning the needle vertically for proper height adjustment. The use of multiple shafts and multiple drive motors increases the complexity and cost of the chenille machine. Thus, there is a need for a method and apparatus to provide automatic steering and height adjustment from a single motor and drive shaft arrangement.

SUMMARY OF THE INVENTION

The present invention disclosed herein comprises a method and apparatus for automatically steering and adjusting the height of the needle in a chenille embroidery machine which eliminates or substantially reduces problems associated therewith on prior chenille machines. The present invention preferably achieves the automatic steering and height adjustment of the needle through use of a single drive motor and a single drive shaft arrangement.

In accordance with one aspect of the invention, an apparatus for automatically steering and adjusting the height of a needle comprises a drive assembly. A shaft assembly interconnects the drive assembly and the needle. Rotational motion is imparted to the needle through the shaft to steer the needle about a longitudinal axis thereof. An actuating device is operably connected to the needle to allow rotational motion to be converted into an axial movement of the needle along the longitudinal axis.

The actuating device comprises an actuator responsive to an electronic signal provided by a controller. A needle bar clamp receives a needle bar into which the needle is threaded, which is in turn positioned in an internal needle height adjuster. A height adjuster locking block receives therein the internal needle height adjuster. Springs are provided for locking and unlocking the height adjuster locking block relative to the internal needle height adjuster in response to the actuator. In the normally locked position the height adjuster locking block and thus the needle rotates with the internal needle height adjuster. When the actuator unlocks the height adjuster locking block from the internal needle height adjuster, the needle is driven vertically to reposition its height.

It is a technical advantage of the present invention that dual drive motors and shaft arrangements are no longer required to automatically impart steering and height adjustment. A single drive motor and shaft arrangement impart rotational motion to steer the needle in the locked position while the actuator unlocks the needle bar clamp from the internal needle height adjuster to utilize the rotational steering motion to drive the needle vertically for height adjustment.

BRIEF DESCRIPTION OF THE DRAWINGS

For a more complete understanding of the present invention and for further advantages thereof, reference is now made to the following Detailed Description taken in conjunction with the accompanying Drawings, in which.

DETAILED DESCRIPTION OF THE INVENTION

A brief overview of the operation of a chenille type embroidery machine will be first described. As in any sewing machine, a vertical up-and-down sewing motion must be imparted to a needle. Due to its particular embroidery functions, a chenille machine, however, also requires several other motions. It is necessary to be able to rotate the needle in order to maintain the needle hook orientation to the pattern to be embroidered as well as to maintain the proper needle hook orientation for a "moss" or a "chain" stitch. Additionally, there is a requirement for adjusting the height of the needle to allow for various "moss" stitch heights and "chain" stitch appearances. Finally, there must be a procedure for raising the needle to a "home" position which clears the design being embroidered.

The invention herein is particularly directed to the rotational steering motion and needle height adjustment. In actuality, there are four functions that are controlled herein by a single motor. The four functions are:

1. rotation of the needle for proper orientation of a "moss" or "chain" stitch;
2. rotation of the needle to maintain proper orientation with the looper and the X/Y frame movement;
3. needle height adjustment to control the "moss" stitch height or "chain" stitch appearance; and
4. needle height adjustment to a "home" position to allow the needle to clear the material upon a thread breakage, a thread color change, or the end of the design.

Due to the invention disclosed herein, these four functions are all controlled by a single drive motor and drive arrangement. The four functions, however, will only be referred to throughout as rotational steering and height adjustment for the sake of simplicity.

Figure 1:
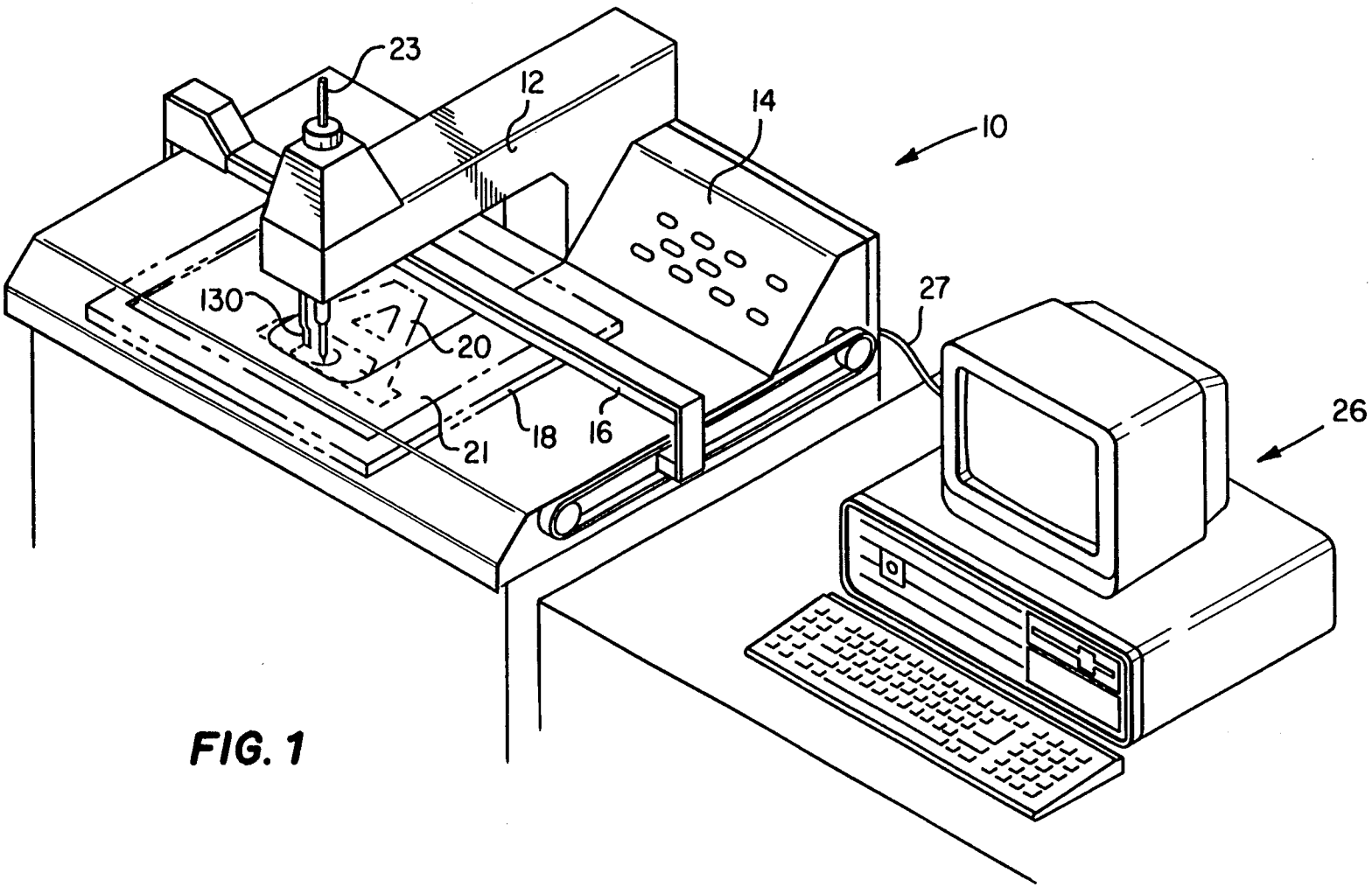
FIG. 1 is a perspective view of a chenille machine constructed in accordance with the preferred embodiment of the present invention.

Referring now to the drawings and first to FIG. 1, a perspective view of a chenille embroidery machine constructed in accordance with a preferred embodiment of the present invention is generally identified by the reference numeral 10. The chenille machine 10 comprises an embroidery head 12 which encloses many of the various components necessary for the operation thereof. Located adjacent the head 12 is a control panel 14 which allows an operator to automatically program the machine 10 for specific operations. An X/Y drive rail !6 is provided to support and drive a hoop assembly 18 (shown in phantom lines) which holds a material 21 to which a design 20 will be embroidered.

The machine 10 has a needle 22 (see FIG. 3) threadably received by a needle bar 23 which forms the stitches (such as "moss" or "chain") required to make the design 20. As is well known in the art, a drive motor and gear arrangement (not shown) is provided to impart vertical sewing motion (a rapid up-and-down linear motion) to the needle 22.

A second drive motor (also not shown) imparts the necessary motion to drive the X/Y drive rail 16. A third drive motor, as will be subsequently described in greater detail, is positioned within the head 12 to provide rotational steering and height adjustment of the needle 22. In an important aspect of the present invention, an actuator 24 (see FIGS. 2, 3, 4 or 5) cooperates with a locking clip 92 (see FIG. 3) to convert rotational steering motion thereof into vertical repositioning of the needle 22.

A controller 26 such as, for example, a personal computer, is interconnected through cables 27 to the machine 10 to provide program input for designs to be embroidered. Once a design program is input through the controller 26, the information is stored within the machine 10 for automatic operation thereof.

Figure 2:
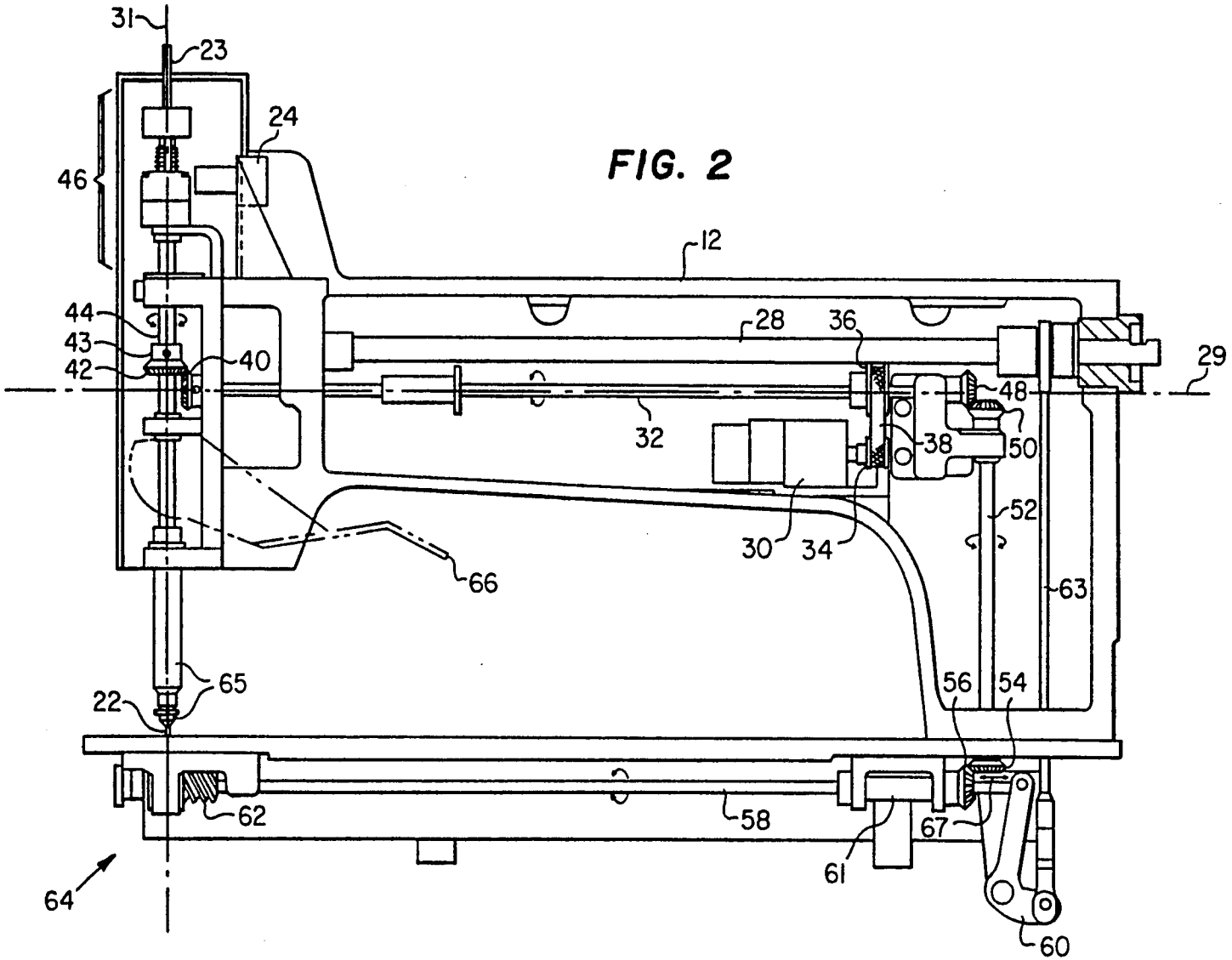
FIG. 2 is a side elevation view of the chenille machine of FIG. 1 with a side cover of the case removed.

Referring to FIG. 2, a side elevation view of the machine 10 is shown with a side cover of the head 12 removed. It is to be understood that only the parts necessary for description of the present invention are depicted and described herein. A main drive shaft 28 imparts vertical up-and-down motion to the needle 22 for embroidering, as is well known in the art. A separate motor (not shown) is provided to drive the main drive shaft 28.

A steering drive motor 30 is positioned within the head 12. A shaft 32 is driven by the motor 30 via pulleys 34 and 36 and a drive belt 38. At an end opposite the pulley 36, a first beveled gear 40 is fixed to the drive shaft 32. A second beveled gear 42 is fixed to a shaft 44 by a collar 43 and meshes with the first beveled gear 40. The shaft 44 receives therein a portion of a needle height adjuster assembly 46 in order to transfer rotational motion thereto. As the shaft 32 is driven, the rotational motion thereof about a horizontal axis 29 is converted into a rotational steering motion about a vertical axis 31 of the needle height adjuster assembly 46 through the beveled gears 40 and 42.

At another end of the shaft 32 proximate the pulley 36, a third beveled gear 48 meshes with a fourth beveled gear 50. The fourth beveled gear 50 is fixed to a vertical drive shaft 52 having on an opposite end thereof a fifth beveled gear 54. The fifth beveled gear 54 meshes with a sixth beveled gear 56 which turns a horizontal shaft 58.

While the beveled gear 56 imparts rotational motion to the horizontal shaft 58, longitudinal motion is imparted therethrough, as is well known in the art, by a rocker arm 60 which is interconnected through appropriate linkage 63 to the main drive shaft 28. On an end of the shaft 58 opposite the sixth beveled gear 56 is a worm gear 62 which forms part of a looper assembly 64. The looper assembly 64 is cooperatingly driven by the steering drive motor 30 as well as the main drive shaft 28 to coordinate the stitches formed by the machine 10.

The shaft 58 provides rotational motion to the looper assembly 64 to maintain synchronization with the steering motion of the needle 22. In other words, as the needle 22 rotates to follow the pre-programmed design 20, the looper assembly 64 must maintain orientation therewith in order to place the thread onto a hook 132 (see FIG. 3) of the needle 22. A sleeve 61 through which the shaft 58 passes, allows the linear motion needed to pull the worm gear 62 back-and-forth, as indicated by a double headed arrow 67. The back-and-forth motion 67 of the worm gear 62 translates into a first rotation cycle of the looper assembly 64 through approximately 400 degrees to loop thread onto the hook 132 of the needle 22 and a second rotation cycle in an opposite direction of approximately 400 degrees to reposition the looper assembly 64. Thus, two rotational motions are provided, one to synchronize the looper assembly 64 with the steering rotation of the needle 22 and another to conduct the looping function.

A pivoting manual release lever 66 is provided on the head 12 to raise and lower a nipple tube and nipple 65 and a presser foot 130 (see FIG. 1). The lever 66 does not effect the vertical repositioning of the needle 22.

Figure 3:
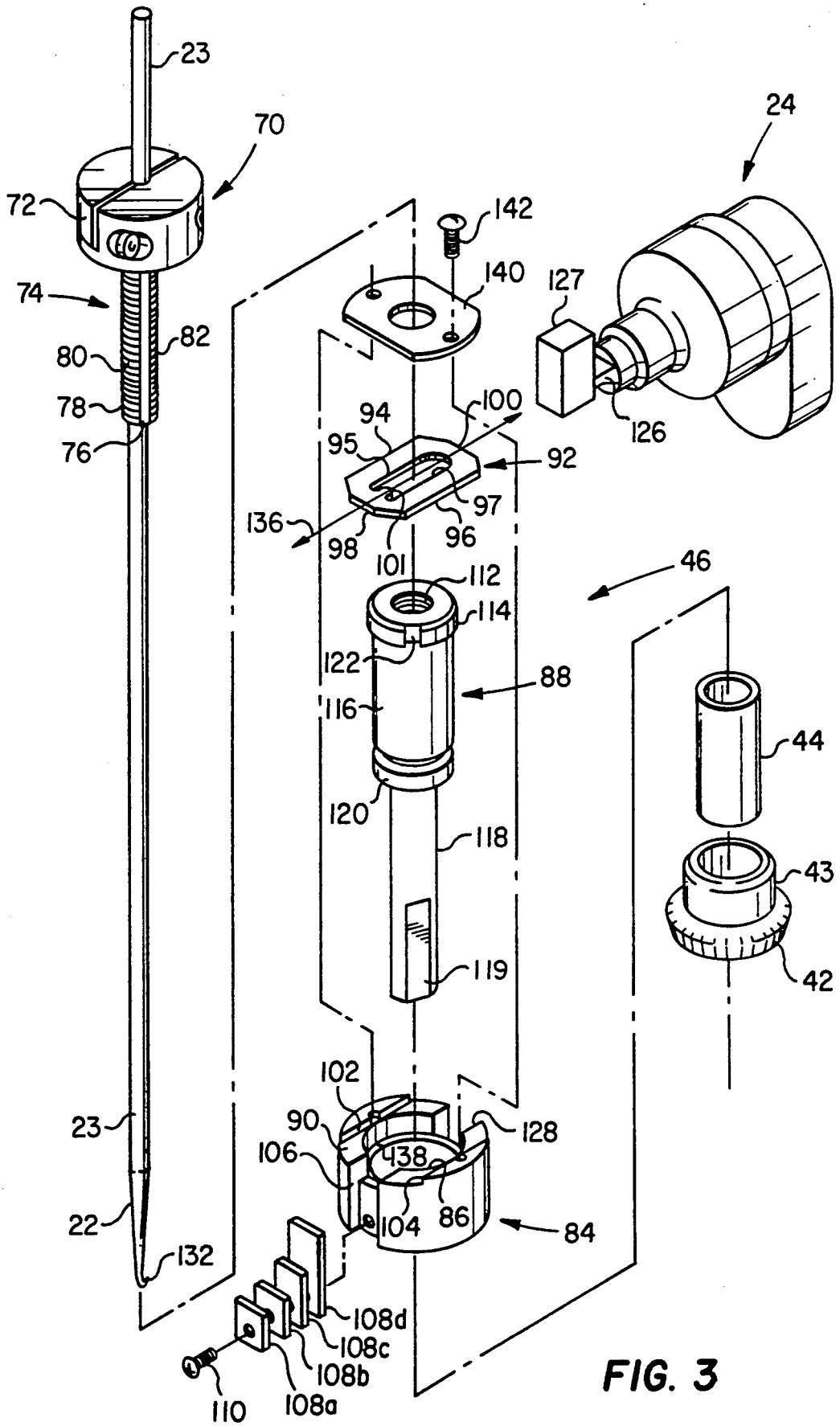
FIG. 3 is an exploded perspective view of the needle adjuster assembly and actuator.

Referring to FIG. 3, an exploded perspective view of the needle height adjuster assembly 46 is shown. The needle 22 having the hook 132 thereon is threadably received by the needle bar 23 which passes through the assembly 46 and is adjustably held therein by a needle bar clamp 70. The needle bar clamp 70 comprises a generally cylindrically shaped portion 72 and a shaft portion 74. The shaft portion 74 has first and second oppositely facing flat sides 76 and 78 and first and second oppositely facing rounded and threaded sides 80 and 82. The rounded and threaded sides 80 and 82 have a plurality of "fine" threads thereon which may comprise, for example, eighty threads per inch, which allow vertical adjustment increments of 0.0125 inches per revolution, as will be subsequently described in greater detail.

A height adjuster locking block 84 has an axial passageway 86 therethrough for rotatably receiving an internal needle height adjuster 88. A cutout 90 is formed in a portion of the locking block 84 for receiving a locking clip 92. The locking clip 92 has first and second oppositely facing external flat sides 94 and 96, first and second oppositely facing angled sides 98 and 100, first and second oppositely facing internal flat sides 95 and 97 and a locking tab 101.

The first and second external flat sides 94 and 96 slidingly match with flat sides 102 and 104, respectively, of the slot 90 on the height adjuster locking block 84. Thus the locking clip 92 may slide linearly in either direction as indicated by a double headed arrow 136 relative to the locking block 84 but is prevented from rotational motion relative thereto.

The locking block 84 also has a first vertical slot 106 for receiving therein four stacked springs 108*a*, 108*b*, 108*c* and 108*d*. The springs 108 *a–d* comprise, for example, pieces of spring steel which are secured within the vertical slot 106 by any appropriate method such as a screw 110. When assembled, the springs 108*a–d* bias the locking clip 92 into locking engagement with the internal adjuster 88. Opposite the first vertical slot 106 is a second vertical slot 128 for cooperation with the actuator 24, as will be subsequently described in greater detail.

The internal needle height adjuster 88 has an axial passageway 112 therethrough which is threaded to receive the fine threads on the rounded and threaded sides 80 and 82 of the shaft portion 74 of the needle bar clamp 70. Therefore, the needle bar clamp 70 is threadable into and out of the internal adjuster 88.

The internal needle height adjuster 88 comprises a first disk shaped portion 114, a cylindrical portion 116 joined thereto, and a tubular portion 118 extending from the cylindrical portion 116. Spaced from the cylindrical portion 116 and on the tubular portion 118 is a second disk shaped portion 120 for cooperation with the up-and-down sewing motion, as previously described above. The tubular portion 118 has a flat portion 119 for internal engagement with the shaft 44 on which the bevelled gear 42 is fastened.

The first disk portion 114 further comprises a slot 122 therein (which may be aligned with the flat portion 119) for engagement by the locking tab 101 of the locking clip 92. When inserted into the height adjuster locking block 84 through passageway 86, the internal adjuster 88 freely rotates therein. The first disk shaped portion 114 rests on a shoulder 138 in the passageway 86 for retention therein.

When assembling the assembly 46, the internal adjuster 88 is inserted into the passageway 86 of the locking block 84. The locking clip 92 is then placed in the slot 90 and secured in place by a plate 140 and bolts 142 (only one of which is shown). The needle bar clamp 70 with the needle bar 23 and needle 22 already locked therein is then inserted into the threaded passageway 112 of the internal adjuster 88.

By grasping the locking block 84 and while ensuring the locking tab 101 of the locking clip 92 is not within the slot 122, the internal adjuster 88 may be rotated to allow the threaded portion 74 of the bar clamp 70 to be threaded into the passageway 112.

Once the bar clamp 70 is at least partially threaded into the internal adjuster 88, the springs 108*a–d* are secured into the slot 106 of the locking block 84 with the screw 110 to bias the locking tab 101 into the slot 122. The assembly 46 is now in its normally locked position in which rotation of the internal adjuster 88 by the motor 30 will cause rotation of the locking block 84 and the needle 22.

It is important to note that the bar clamp 70 is free to be threaded into or out of the internal adjuster 88 if the locking clip 92 is not installed. The matching of the flat sides 95 and 97 of the clip 92 with the flat sides 76 and 78 of the bar clamp 70 and the flat sides 94 and 96 with the flat sides 102 and 104 of the locking block 84, prevent rotation of the bar clamp 70 relative to the internal adjuster 88. However, even with the clip 92 installed, if the tab 101 is not engaged in the slot 122 of the internal adjuster 88, the internal adjuster 88 is free to rotate relative to the bar clamp 70.

Positioned opposite the height adjuster locking block 84 on the head 12 is the actuator 24. The actuator 24 comprises, for example, a digital linear actuator with a modified stepper motor, for example, such as is available as a Series K-92100 from Airpax.

The actuator 24 includes an actuator shaft 126 which extends therefrom in response to an electronic signal from the control panel 14. In its unactuated position, the actuator shaft 126 does not engage the locking clip 92. Upon actuation, the actuator shaft 126 and a block 127 fixed thereto extend from the actuator 24 and press the locking clip 92 against the bias of the springs 108*a–d* to disengage the tab 101 from the slot 122 in the internal adjuster 88.

Figure 4:
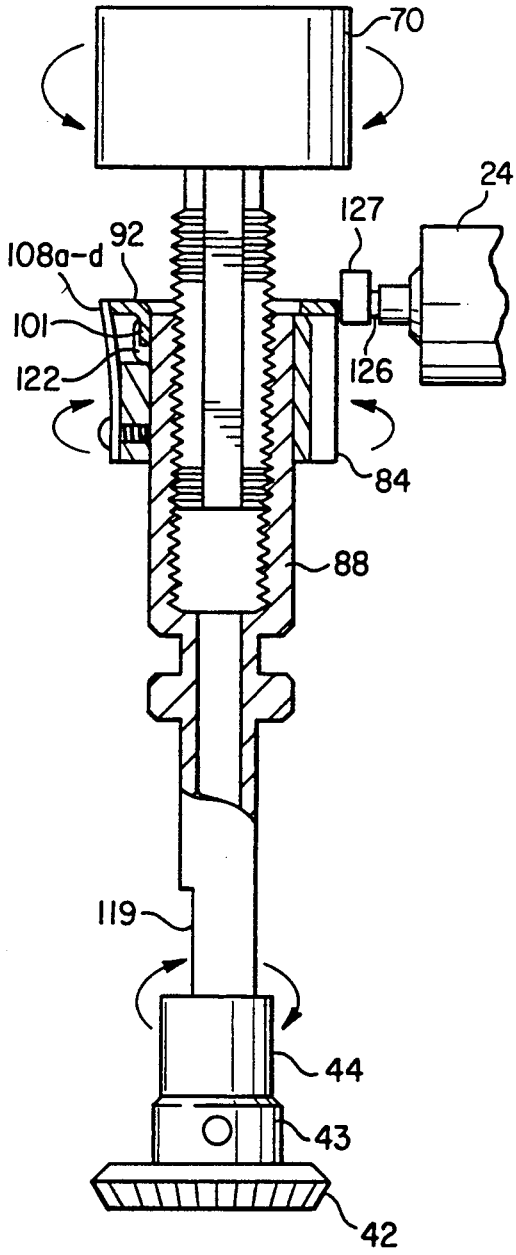
FIG. 4 is a cross-sectional view of the actuator in position for normal operation.

In operation, the actuator shaft 126 is normally in its unactuated position near the actuator 24 (see FIG. 4). The locking clip 92 is biased by the springs 108*a–d* to place the locking tab 101 within the slot 122 of the internal adjuster 88. With the assembly 46 in the normally locked position, when the drive motor 30 (see FIG. 2) turns the drive shaft 32 transferring rotational motion through the first and second beveled gears 40 and 42 to the shaft 44, the internal adjuster 88 is rotated.

Since the internal adjuster 88 is locked via the locking tab 101 of the locking clip 92 to the locking block 84, the needle 22, the needle bar 23 and the needle bar clamp 70 rotate as the internal adjuster 88 and the locking block 84 rotate.

Figure 5:
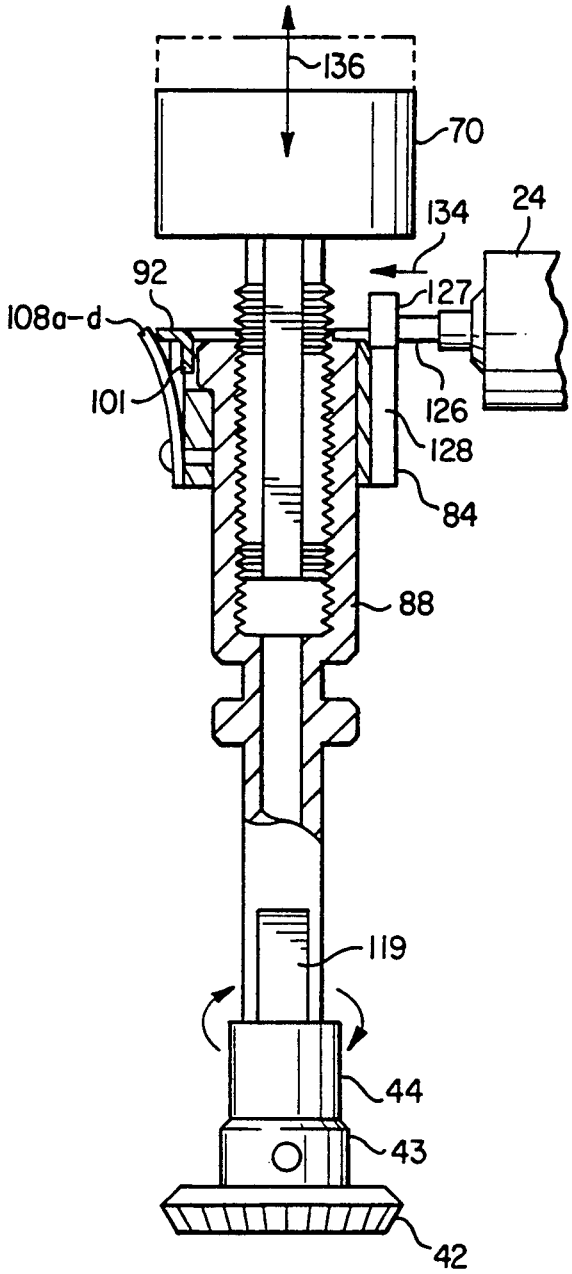
FIG. 5 is a cross-sectional view of the actuator being actuated to adjust the needle height.

Referring to FIG. 5, upon receipt of an electronic signal, the actuator shaft 126 is extended in a direction indicated by an arrow 134 from the actuator 24 to place the actuator block 127 into contact with the locking clip 92. As the actuator block 127 engages the locking clip 92, the locking tab 101 is disengaged from the slot 122 on the internal adjuster 88.

As the locking clip 92 is moved in the direction 134 by the actuator block 127, the actuator block 127 also engages the slot 128 in the locking block 84 to prevent rotation thereof. Thus, the internal adjuster 88 is released from engagement with the locking clip 92 and is freely rotatable relative to the locking block 84 which is now locked in position by the actuator block 127.

Since the flat sides 95 and 97 of the locking clip 92 hold the bar clamp 70 from rotation relative to the internal adjuster 88, as the internal adjuster 88 continues to rotate, the needle bar clamp 70 is threaded into or out of the axial passageway 112 therein in a vertical direction, as indicated by a double headed arrow 136. By comparing FIG. 4 and FIG. 5, it can be seen that the bar clamp 70 (and thus the needle 22 and the needle bar 23) has been lowered from the position in FIG. 4 (phantom position of FIG. 5) to the position as shown in solid lines in FIG. 5.

Thus, due to the present invention, a single drive motor 30 controls the rotational steering and height adjustment of the needle 22. The drive motor 30 controls the rotational steering of the needle 22 when the actuator 24 is in the normal "unactuated" condition. The drive motor 30 also controls the height adjustment of the needle 22 by converting the rotational motion into a linear motion when the actuator 24 is in the "actuated" condition.

Although the present invention has been described with respect to a specific preferred embodiment thereof, various changes and modifications may be suggested to one skilled in the art, and it is intended that the present invention encompass such changes and modifications as fall within the scope of the appended claims.

What is claimed is:

1. An apparatus for automatically adjusting a height of a needle in an embroidery machine, comprising:

a needle height adjuster assembly comprising a first portion rotatably inserted into a second portion, wherein the needle is adjustably received by said first portion;

means for rotating said needle assembly about a longitudinal axis of the needle; and means for disengaging said second portion of said assembly from said first portion of said assembly including the needle, wherein the height of the needle is adjusted by rotating said first portion while said second portion is disengaged therefrom.

2. The apparatus of claim 1, wherein said needle height adjuster assembly comprises:

a needle bar clamp for fixedly receiving a needle bar and the needle;

said first portion of said needle bar height adjuster assembly comprises an internal needle height adjuster for threadably receiving said needle bar clamp; and said second portion of said needle height adjuster comprises a height adjuster locking block for rotatably receiving said internal adjuster.

3. The apparatus of claim 2, wherein said means for rotating comprises:

a drive motor; and shaft means rotatably interconnecting said motor and said internal needle height adjuster.

4. An apparatus for automatically adjusting a height of a needle in an embroidery machine, comprising:

a needle height adjuster assembly comprising a needle bar clamp for fixedly receiving a needle bar and the needle, an internal needle height adjuster for threadably receiving said needle bar clamp, and a height adjuster locking block for rotatably receiving said internal adjuster;

means for rotating said needle assembly; and means for disengaging said needle assembly from the needle, said means for disengaging comprising:

a spring biased locking clip slidably received by said locking block for locking said locking block to said internal adjuster; and an actuator for sliding said clip against said spring bias, wherein said locking block is unlocked from said internal adjuster and the needle is threaded into or out of said internal adjuster as said internal adjuster rotates to adjust the height of the needle.

5. The apparatus of claim 4, wherein said actuator comprises:

a linear actuator.

6. An apparatus for adjusting a sewing height and for rotationally steering a needle in an embroidery machine, comprising:

drive means;

shaft means interconnecting said drive means and the needle for imparting rotational motion to steer the needle about a longitudinal axis, and means operably connected to the needle for converting said rotational motion of the needle into a substantially vertical motion to adjust the sewing height of the needle along said longitudinal axis.

7. An apparatus for steering and for adjusting a height of a needle in an embroidery machine, comprising:

drive means;

shaft means interconnecting said drive means and the needle for imparting rotational motion to steer the needle about a longitudinal axis thereof; and means operably connected to the needle for converting said rotational motion into a substantially vertical motion of the needle along said longitudinal axis, said means for converting comprising:

an actuator responsive to an electronic signal;

a needle bar clamp for receiving a needle bar and the needle;

an internal height adjuster for threadably receiving said needle bar clamps; 'a height adjuster locking block for rotatably receiving said internal adjuster; and spring means comprising at least one spring and a locking clip for rotationally locking and unlocking said locking block relative to said internal adjuster responsive to said actuator, wherein said spring means normally locks said locking block for said rotational motion with said internal adjuster and unlocks said locking block relative to said internal adjuster for said axial motion.

8. The apparatus of claim 7, wherein said actuator further comprises:

an actuator shaft slidably received within said actuator, said actuator shaft including an attached actuator block for engagement with said spring means upon actuation of said actuator shaft.

9. The apparatus of claim 7, wherein said actuator further comprises:

a linear actuator.

10. The apparatus of claim 7, wherein said needle bar clamp further comprises:

a cylindrical portion having a first external diameter and a passage therethrough for receiving the needle bar therein; and a threaded portion connected to said cylindrical portion, said threaded portion having a second external diameter smaller than said first diameter and a passageway therethrough for receiving the needle bar, said second portion being externally threaded for engagement with said internal adjuster.

11. The apparatus of claim 10, wherein said threaded portion further comprises:

first and second oppositely facing threaded portions; and first and second oppositely facing flat portions for engagement with a portion of said locking clip.

12. The apparatus of claim 7, wherein said means for converting further comprises:

said locking clip slidably received by said locking block, said locking clip having a locking tab thereon; and a slot on said internal adjuster for receiving said locking tab, wherein said at least one spring biases said tab of said clip into said slot.

13. The apparatus of claim 7, wherein said height adjuster locking block comprises:

a cylindrically shaped portion having a passageway therethrough for receiving said internal height adjuster, a first slot for slidably receiving said locking clip engageable by said at least one spring, a second slot transverse to said first slot for receiving said at least one spring, and a third slot opposite said second slot for engagement by said actuator.

14. The apparatus of claim 7, wherein said internal adjuster comprises:

a first disk portion having a first diameter;

a tubular portion; and a cylindrically shaped portion interconnecting said first disk portion and said tubular portion and having a second diameter smaller than said first diameter.

15. A chenille embroidery machine, comprising:

a needle bar assembly including a needle having a hook thereon in which the position of said hook is used in embroidering a desired stitch; and a single motor for both rotating said needle without accompanying vertical movement of said needle and for rotating said needle with accompanying vertical movement of said needle, wherein said single motor is used in both positioning said hook and adjusting the height of said needle.

16. A method for automatically adjusting a height of a needle on an embroidery machine, comprising the steps of:

rotating a needle height adjuster assembly comprising a first portion rotatably inserted into a second portion, wherein the needle is adjustably received by said first portion;

disengaging said second portion from said first portion of said assembly including the needle; and continuing to rotate said first portion while said second portion is disengaged therefrom, wherein the height of the needle is adjusted.

17. A method for automatically adjusting a height of a needle on an embroidery machine, comprising:

rotating a needle height adjuster assembly containing the needle; and moving a locking clip on said needle assembly with an actuator to unlock the needle from rotation with said assembly, wherein as said needle assembly continues to rotate the height of the needle is adjusted.

18. The method of claim 17, wherein the step of disengaging further comprises the steps of:

actuating said actuator to hold a height adjuster locking block of said needle assembly from rotation; and rotating an internal needle height adjuster rotatably received by said locking block.

19. The method of claim 18, wherein the step of actuating comprises:

extending a shaft from said actuator to place an attached actuator block into contact with a slot on said locking block.

20. A method for steering and for adjusting a height of a needle in an embroidery machine, comprising the steps of:

threading a needle bar clamp containing a needle bar and the needle into an internal needle height adjuster;

rotating said internal adjuster;

locking a height adjuster locking block and said clamp to said internal adjuster, wherein said clamp rotates with said internal adjuster to steer the needle;

unlocking said locking block and said clamp from said internal adjuster; and holding said locking block from rotation while said internal adjuster continues to rotate, wherein said needle bar clamp is threaded into or out of said internal adjuster for height adjustment of the needle.

21. The method of claim 20, wherein the step of locking comprises:

spring biasing a locking clip which is slidably received by said locking block to engage a locking tab on said clip with a slot in said internal adjuster.

22. The method of claim 20, wherein the step of unlocking comprises:

moving a locking tab on a locking clip which is slidably received by said locking block out of a slot on said internal adjuster.

23. The method of claim 22, wherein the step of moving further comprises the step of:

actuating an actuator to extend a shaft therefrom into contact with said locking clip.

24. The method of claim 20, wherein the step of holding comprises:

extending an actuator shaft and attached actuator block into engagement with a slot on said locking block.

25. A method for forming a needle steering and height adjustment apparatus for an embroidery machine, comprising the steps of:

inserting a needle bar into which the needle is threadably received into a needle bar clamp;

threading said clamp into an internal needle height adjuster;

rotatably inserting said internal adjuster into a height adjuster locking block;

positioning an actuator having an extendable shaft opposite said locking block; and slidably inserting a spring biased locking clip into said locking block, wherein said clip is biased to lock said locking block to said internal adjuster for steering the needle and said clip is moved against said bias by said extendable shaft to unlock said locking block from said internal adjuster for height adjustment of the needle.

* * * * *